US005148861A

United States Patent [19]

Colvin et al.

[11] Patent Number: 5,148,861

[45] Date of Patent: Sep. 22, 1992

[54] QUICK DISCONNECT THERMAL COUPLER

[75] Inventors: David P. Colvin, Apex; James C. Mulligan; Benjamin T. Gravely, both of Raleigh, all of N.C.

[73] Assignee: Triangle Research and Development Corporation, Research Triangle Park, N.C.

[21] Appl. No.: 738,849

[22] Filed: Jul. 31, 1991

[51] Int. Cl.[5] ..... F28F 5/00

[52] U.S. Cl. ..... 165/78; 165/86; 165/156

[58] Field of Search ..... 165/76, 78, 104.14, 165/86, 156, 142; 62/298

[56] References Cited

U.S. PATENT DOCUMENTS

| | | | |
|---|---|---|---|
| 2,630,688 | 3/1953 | Merkling | 62/298 |
| 4,537,247 | 8/1985 | Okamoto et al. | 165/78 |
| 4,799,541 | 1/1989 | Buna et al. | 165/78 |

*Primary Examiner*—Albert W. Davis, Jr.
*Attorney, Agent, or Firm*—Rosenthal & Putterman

[57] ABSTRACT

A quick disconnect heat exchanger is disclosed wherein male and corresponding female members are adapted to be slidably interconnected. Each of the respective male and female members includes a discrete fluid flow so that fluids are not mixed during heat exchange and the coupler may be disconnected without fluid loss or mixing.

9 Claims, 3 Drawing Sheets

QUICK DISCONNECT THERMAL COUPLER

This invention was made with Government support under contract no. F33615-86-C-3430 awarded by the United States Air Force. The Government has certain rights in this invention.

FIELD OF THE INVENTION

This invention relates generally to the field of heat exchangers and more particularly to heat exchangers of the type where thermal energy is transferred between two discrete fluid loops.

BACKGROUND OF THE INVENTION

The heat exchanger is a well known apparatus extensively used in thermodynamic systems as a means of conducting thermal energy into or out of the system depending on the particular system needs.

A conventional heat exchanger transfers thermal energy between two fluid loops. For example, in systems where a heat source generates waste thermal energy which must be removed from the system to prevent system failure, the waste heat is conducted away from the system to a thermal radiator. More specifically, the waste heat is usually carried away from the heat source by a first heat exchange fluid flowing in a primary fluid cooling loop. The primary fluid then transfers the waste heat to or from a second heat exchange fluid flowing in a secondary cooling loop, the heat exchange taking place in a heat exchanger. However, many types of systems utilize exotic cooling fluids or have other specialized requirements such a the need to minimize the amount of cooling fluid pumped.

A typical heat exchanger may include a helical coil through which the primary heat exchange fluid is pumped. The coil is positioned within a housing that has an inlet and an outlet positioned at opposite ends of the housing. The secondary heat exchange fluid flows through the housing and around the coil, the actual heat exchange taking place through the boundary or wall between the two circulating heat exchange fluids. The maintenance or repair of heat exchangers can be a burdensome and time consuming task when decoupling of the fluid circuits is required. For example, in gravity free space applications or computer applications, the cooling fluids used are generally incompatible with electrical components and the surrounding environment. In such cases, decoupling may require large quantities of possibly expensive and exotic fluids to be carefully drained from the system with care being taken to prevent loss, mixing, or contamination of the fluids. After the scheduled maintenance or necessary repairs to the system have been completed, the fluids must be replaced with care being taken to again avoid the aforementioned problems of loss, mixing and contamination. Thus, it will be seen that a system for decoupling fluid loops in a heat exchanger where draining is not required would provide substantial benefits.

In view of the foregoing, it is an object of the present invention to provide a thermal coupler which permits two fluid loops containing heat exchange fluids to be quickly disconnected.

It is a further object of the present invention to provide a thermal coupler which permits fluid loops to be disconnected without fluid loss.

It is another object of the present invention to provide a thermal coupler which permits fluid loops to be disconnected without fluid mixing between fluid loops.

It is a still further object of the present invention to provide an efficient thermal coupler wherein an enhanced amount of thermal energy can be transferred between the circulating fluids while minimizing surface area and weight.

It is a still further object of the present invention to provide a modular thermal coupler system which allows electrical and space applications to be constructed wherein heat is transferred between multiple secondary fluid loops and a single primary fluid loop.

These and other objects ar accomplished generally by providing a heat exchanger for thermally coupling a pair of discrete thermal loops, each loop adapted to carry a heat exchange fluid for transferring thermal energy between the loops. The thermal coupler includes a male member and a female member, each connected to a separate fluid circuit. The female member comprises a housing having an outer wall and including an opening defining a cavity and further defining the inner wall of the female member. A first chamber is defined by the inner and outer walls of the female member. The female member also includes spaced apart inlet and outlet means in fluid communication with the first chamber.

A male member includes a second chamber and has a second outer wall. The male member also includes second inlet means and second outlet means located in its outer wall that are in fluid communication with the second chamber. The male member is adapted to be slidably received within the cavity of the female member. The outer wall of the male member is in substantial contacting thermal energy transfer relation with the inner wall of the female member whereby thermal energy is transferred between the first and second fluid flow paths as the circulating heat exchange fluids flow through the heat exchanger.

BRIEF DESCRIPTION OF THE DRAWINGS

Some of the features and advantages of the invention having been briefly stated, others will appear from the detailed description which follows, when taken in connection with the accompanying drawings, in which.

DETAILED DESCRIPTION OF THE ILLUSTRATED EMBODIMENT

While the present invention will be described more fully hereinafter with reference to the accompanying drawings, in which a particular embodiment is shown, it is to be understood at the outset that persons skilled in the art may modify the invention herein described while still achieving the favorable results of this invention. Accordingly, the description which follows is to be understood as a broad teaching disclosure directed to persons of skill in the appropriate arts and not as limiting upon the present invention.

Figure 1:
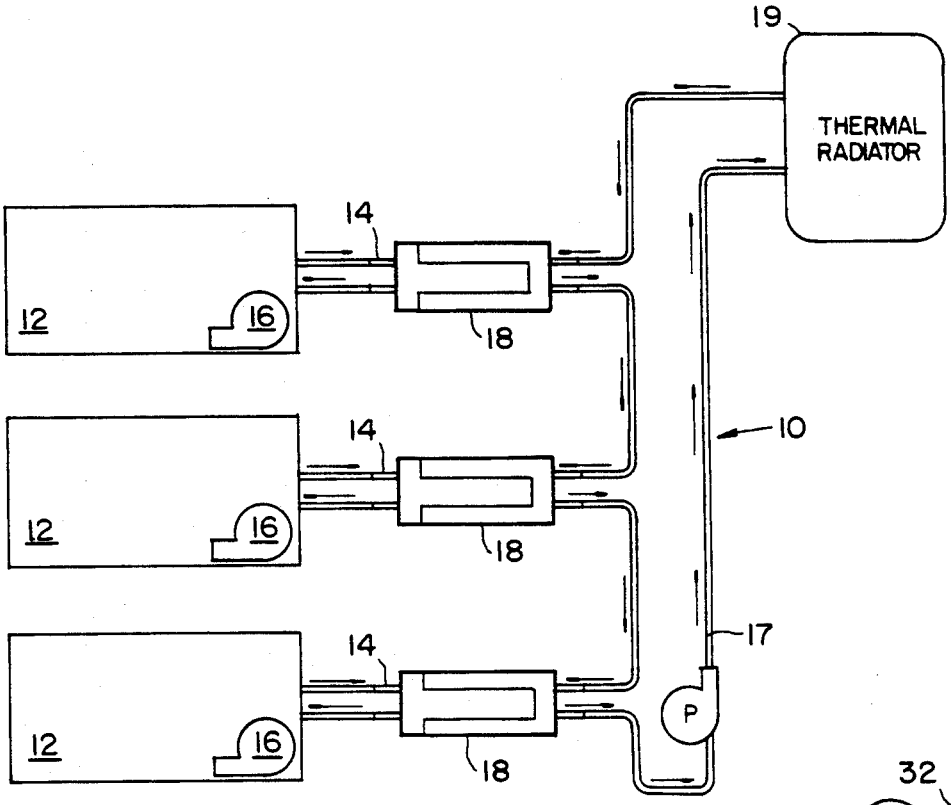
FIG. 1 is a schematic drawing of the thermal coupler of the present invention used in conjunction with an electronic system that includes multiple printed circuit boards, each of which includes a primary closed thermal loop and each of which is thermally connected via the present coupler to a secondary thermal loop which is designed to pick up the heat generated by the circuit boards and to carry the same to a remotely located radiator.

In FIG. 1, a portion of a thermodynamic system 10 using the present invention such as a computer is shown schematically. The system 10 includes a plurality of heat sources such as circuit boards 12, each of which includes a number of heat generating electronic components which may include memory or control integrated circuits, resistors, capacitors and the like (not shown). Each circuit board 12 is equipped with fluid flow loop 14 which may include a miniature pump 16 (depicted schematically) for circulating a heat exchange fluid in proximity to the electronic components and to transfer the heat generated therefrom to the heat exchange fluid flowing in each of the primary fluid loops.

Also shown in FIG. 1 is a primary fluid flow loop 17 which may include a pump P that circulates a second heat exchange fluid around the loop and a thermal radiator 19 which transfers any thermal energy present in the second heat exchange fluid flowing in the loop to a reservoir. In operation, a heat exchange fluid is pumped around the secondary fluid loops and in heat transfer relation to each of heat sources 12. Thermal energy is transferred from the heat exchange fluid flowing in each of the secondary fluid flow loops to the heat exchange fluid flowing in the primary fluid flow via the novel thermal coupler or heat exchanger 18 of the present invention. Thermal coupler 18 connects each of the fluid flow loops 1 associated with each of the heat sources 12 to the primary flow loop with actual exchange taking place within each of the thermal couplers 18. Once the thermal energy or heat has been transferred from the heat exchange fluid flowing in the secondary fluid flow loop across thermal coupler 18 and into the primary heat exchange fluid flowing in the primary fluid flow loop, it is pumped via pump P to the thermal radiator 19 which cools the fluid before it is recirculated to thermal coupler 18 to again receive thermal energy.

Referring now to FIGS. 2 through 7, the thermal coupler of the present invention generally indicated at 18 is there illustrated in detail. The thermal coupler 18 comprises a female member 20 and a male member 40.

Figure 2:
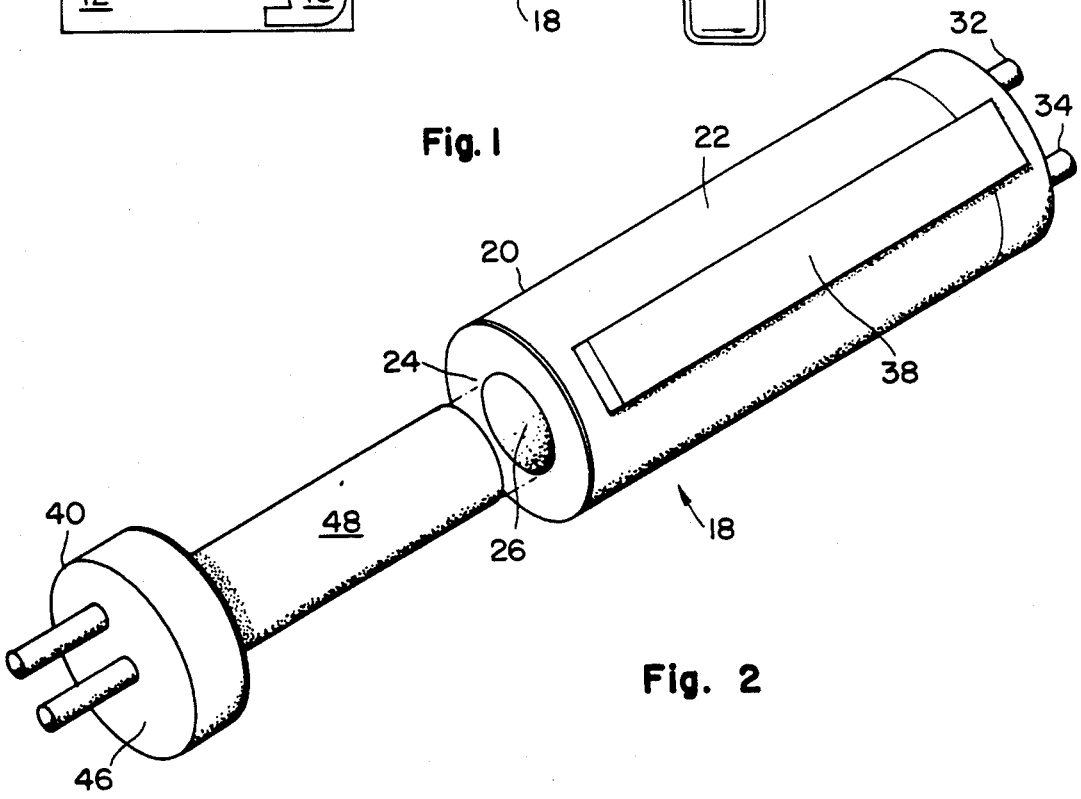
FIG. 2 is a perspective view of the thermal coupler of the present invention showing the female member and male member pulled apart and disconnected from each other.
Figure 3:
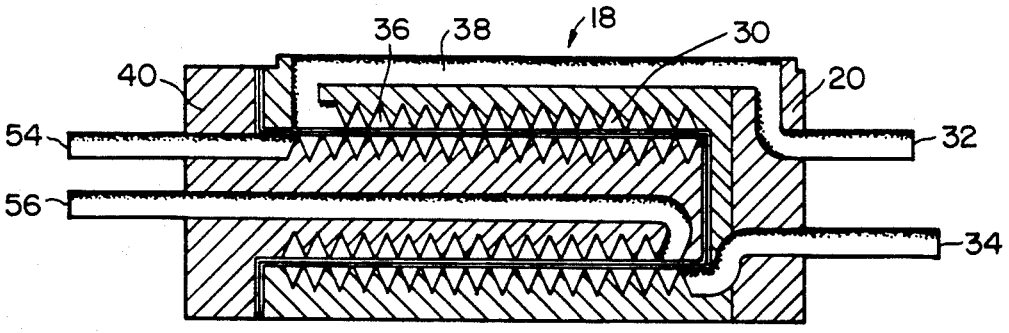
FIG. 3 is a side cross-sectional view of the thermal coupler of the present invention showing the fluid flow paths in the male and female members and their respective alignment.
Figure 4:
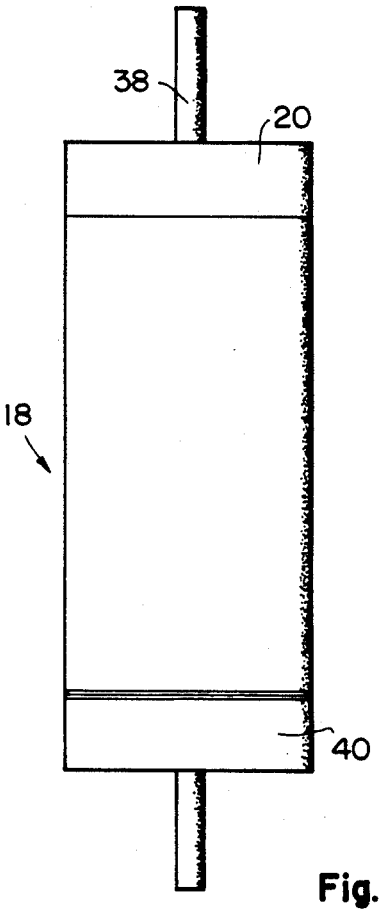
FIG. 4 is a side view of the thermal coupler of the present invention showing the male and female members connected together.
Figure 5:
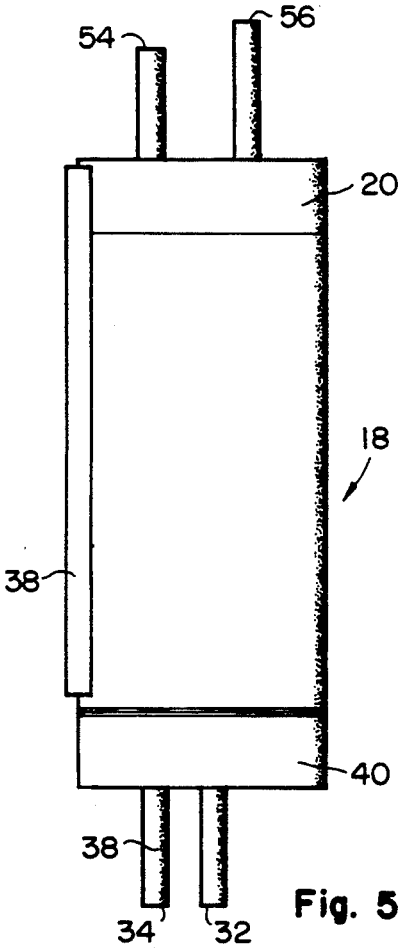
FIG. 5 is another side view of the thermal coupler of the present invention showing the male and female members connected together and more specifically showing the external manifold on the female member.
Figure 6:
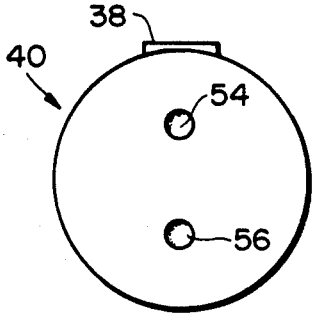
FIG. 6 is an end view of the male member of the thermal coupler and showing the second inlet means and the second outlet means.
Figure 7:
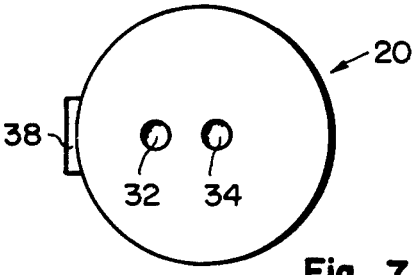
FIG. 7 is an end view of the female member component of the thermal coupler of the present invention and showing the inlet means and the outlet means.
Figure 8:
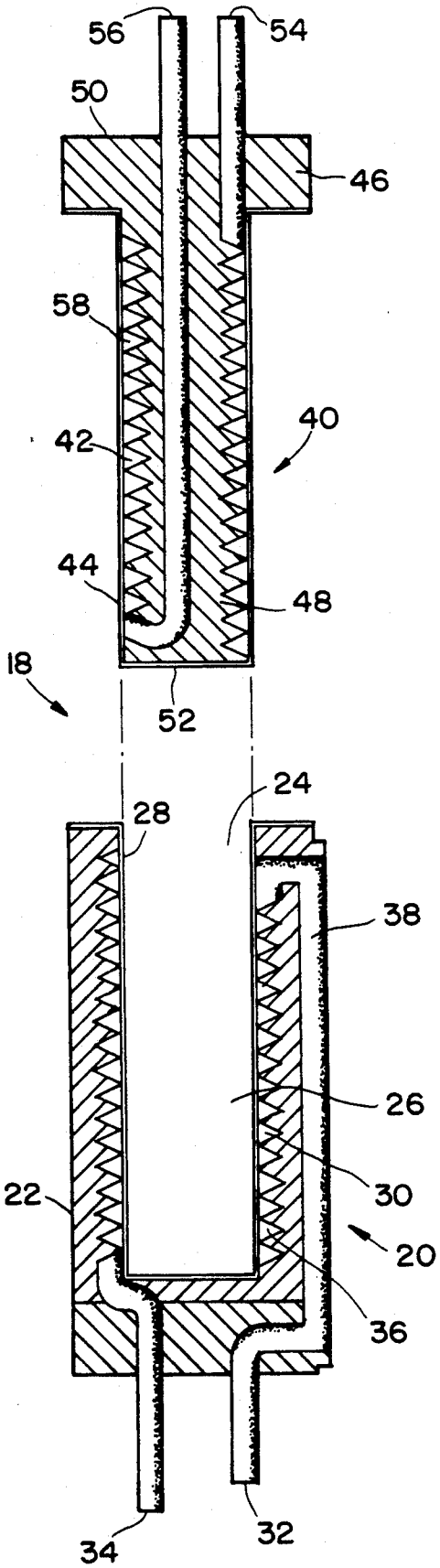
FIG. 8 is a side cross sectional view of the thermal coupler of the present invention showing the female member and the male member pulled apart and disconnected from each other.

According to the present invention and best illustrated in FIGS. 2, 3 and 8, the female member 20 is an elongate cylinder having an outer wall 22 and includes an opening 24 at one of its ends that defines a cavity 26. The cavity 26 is a cylindrical bore that extends longitudinally along substantially the entire length of the female member 20 and defines an inner wall 28.

Female member 20 also includes a first chamber 30 which is located between and is defined by the respective outer and inner walls 22, 28. Inlet means 32 and outlet means 34 are in fluid communication with the first chamber 30. The inlet means 32 and outlet means 34 are spaced apart at the one end of female member 20 as best shown in FIGS. 3 and 8.

As shown in FIG. 3, the first chamber 30 includes guide means 36 for directing the heat exchange fluid flowing in the female member 20 along the longitudinal axis so that the fluid makes plural passes around the periphery of the female member. Specifically, in the illustrated embodiment, the heat exchange fluid is directed in a substantially helical fluid flow path from the inlet means 32 along the length of the chamber 30 to the outlet means 34.

It will be noted that the chamber 30 is located in proximity to the inner wall 28 of female member 20. This positioning facilitates heat transfer between the first and second thermal loops as will be described in greater detail hereinbelow.

Female member 20 also includes a manifold 38 that extends along the outer wall 22 of the female member 20 from one end to the other thereof and which defines a fluid flow pathway that connects the inlet means 32 to the chamber 30. The outlet means 34 is similarly connected to the opposite end of chamber 30. It should be noted that manifold 38 could be incorporated into the body of housing 20 by those skilled in the art, but is specifically enumerated herein for clarity.

The inner wall of bore 28 is provided with a material 70 having enhanced heat transfer characteristics, such as copper alloys, nickel, stainless steel or other material compatible with the fluid in use. This lining covers the entire inner wall of the bore as well as the terminating end thereof.

The heat exchanger also includes a male member 40 that defines a second chamber 42 and includes an outer wall 44. Male member 40 comprises a disk 46 and an integral cylindrical core 48. The core 48 has an outer end 50 and an inner end 52 which is located proximate the core 48. The male member 40 is configured to be slidably and removably received within the cavity 26 of the female member 20 in substantial contacting thermal energy transfer relation therewith. More specifically, the core portion 48 of the male member 40 has its outer wall 44 wrapped in a material 70 having enhanced heat transfer characteristics, in the manner as described above. The length and diameter of core 48 may be slightly smaller than the corresponding length and diameter of the opening 24 in female member 20. In order to assure good thermal contact between the female member 20 and the male member 40, a snug fit is required. One method of obtaining such a fit is to produce the core 48 and the cavity 26 with a slight taper between the adjacent parts. Extending through disk 46 is a second inlet means 54 and a second outlet means 56.

The core portion 48 of the male member 40 defines a second chamber 42 that includes a second guide means for directing the heat exchange fluid flowing in the male member 40 along the longitudinal axis so that the fluid makes plural passes around the periphery of the male member. Specifically, in the illustrated embodiment, the guide means or fluid flow directing means 58 is helical and extends along substantially its entire length. The male member 40 includes a second inlet means 54 and second outlet means 56 that are in fluid communication with opposite ends of the second fluid flow directing means 58. In the illustrated embodiment, the second fluid flow directing means 58 is helical and is located proximate the outer wall 44 of the core 48.

The reader will note that in the embodiment illustrated, particularly as shown in FIG. 3, that the first and second flow paths in both the female and male members, 20, 40 are "V" shaped and further, that when the core 48 is maximally inserted within the cavity 26, that the respective wide ends of the "V" shaped groves or threads overlie each other. This serves to establish a helical flow pattern and to maximize the surface area available for heat transfer between the heat exchange fluids flowing in the first and second fluid flow directing means 36, 58.

The reader will note that although the fluid flow directing means illustrated are a distinctly shaped helical flow channels, that other fluid flow configurations may be chosen. For example, a helical flow can be achieved within the chambers above without requiring any internal channelling structure at all. For example, a helical fluid flow path can be achieved by having the fluid enter targetial to the desired direction of fluid flow.

In operation, a first heat transfer fluid is pumped via pump P into first inlet means 32, down the flow pathway defined by manifold 38 and into the first fluid flow directing means 36. The fluid circulates around the helix and toward the outlet end of the first fluid flow path at which time the fluid exits the housing 20 via the outlet means 34. Similarly, a second heat exchange fluid is pumped into the male member 40 through inlet means 54 and the core 48. The fluid circulates through the helical fluid flow directing means 58 of the male member 40 as shown in FIG. 3 and exits through outlet means 56. The flow directions of the two fluids are chosen so that the heat exchanger acts in the so-called counter-flow mode for maximum heat transfer effectiveness.

Figure 9A:
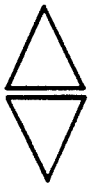
FIGS. 9*a* and 9*b* are a side view of a portion of the fluid flow paths showing the secondary flow caused by temperature induced buoyancy forces in the heat exchange fluids.
Figure 9B:
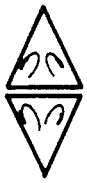

In addition, the unique configuration of the present thermal coupler employs centrifugal force to further enhance thermal energy transfer between the first and second fluid flow loops. More specifically, it is known that the density of a cold fluid is greater than that of the same fluid in a warmer state. As a result of the helical configuration of the fluid flow paths, a secondary flow due to temperature induced buoyancy causes the denser (colder) fluids to be pushed to the outer surfaces of the fluid flow paths. As shown in FIG. 9, this action juxtaposes the coldest fluid in the inside loop with the hottest fluid in the outside loop, thereby increasing efficiency.

The foregoing embodiment and example is to be considered illustrative, rather than restrictive of the invention, and those modifications which come within the meaning and range of equivalence of the claims are to be included therein.

That which is claimed is:

1. A quick disconnect heat exchanger for thermally coupling first and second discrete thermal loops, each loop adapted to carry a circulating heat exchange fluid and comprising:

a female member having an outer wall and an opening defining a cavity and whereby said cavity defines further an inner wall, a first chamber defined by the inner and outer walls of said female member, spaced apart inlet means and outlet means in fluid communication with said first chamber, a male member defining a second chamber and having a second outer wall, spaced apart second inlet means and second outlet means in fluid communication with said second chamber, said male member being adapted to be removably received within the cavity of said female member and wherein the outer wall of said male member is in substantial contacting thermal energy transfer relation with the inner wall of said female member, said chamber and said second chamber each having guide means for directing the fluid along the longitudinal axis of the respective male and female member so that the fluids make plural passes around the periphery of the respective male and female members;

whereby thermal energy is transferred between the first and second thermal loops as the heat exchange fluids flow through the respective first and second chambers of the heat exchanger when the female member and the male member are connected and wherein the first and second thermal loops may be decoupled by separating the male member and the female member without fluid loss, contamination or mixing of the heat exchange fluids.

2. An apparatus according to claim 1 wherein the outer wall of said male member and the inner wall of said female member comprises a material having enhanced heat transfer characteristics.

3. An apparatus according to claim 2 wherein said material having enhanced heat transfer characteristics is a metal.

4. An apparatus according to claim 3 wherein said metal is copper.

5. An apparatus according to claim 1 wherein said guide means directs the fluid in a helical path.

6. An apparatus according to claim 1 wherein said guide means directs the heat exchange fluid flowing in the female member in a substantially helical fluid flow path from the inlet means along the length of the chamber to the outlet means, and wherein said said guide means further directs the heat exchange fluid flowing in the male member in a substantially helical fluid flow path from the second inlet means along the length of the chamber to the second outlet means.

7. A quick disconnect heat exchanger for thermally coupling first and second discrete thermal loops, each loop adapted to carry a circulating heat exchange fluid and comprising:

a female member comprising an outer wall and an opening defining a cylindrical cavity, said cavity defining an inner wall; p1 a first chamber being defined between the inner and outer walls of said female member;

inlet means and outlet means in fluid communication with said first chamber;

said inner wall comprising a material having enhanced heat transfer characteristics;

a cylindrical male member defining a second chamber and having an outer wall comprised of a material having enhanced heat transfer characteristics;

a second inlet and second outlet means in fluid communication with said second chamber, said male member being adapted to be removably received within said cavity of said female member and wherein the outer wall of said male member is in substantially contacting relation with the inner wall of said female member, said chamber and said second chamber each having guide means for directing the fluid along the longitudinal axis of the respective male and female members so that the fluids make plural passes around the periphery of the respective male and female members;

whereby thermal energy is transferred between the first and second thermal loops as the heat exchange fluids flow through the respective first and second chambers of the heat exchanger when the female member and the male member are connected and wherein the first and second thermal loops may be decoupled by separating the male member and the female member without fluid loss, contamination or mixing of the hat exchanger fluids.

8. An apparatus according to claim 7 wherein said guide means in said chamber and said second chamber defines helical fluid flow paths along their respective lengths.

9. An apparatus according to claim 8 wherein said helical flow paths are arranged to provide maximum thermal gradient between the heat exchange fluids as they flow along the length of said respective flow paths.

* * * * *